United States Patent [19]

Pilney et al.

[11] Patent Number: 4,699,164

[45] Date of Patent: Oct. 13, 1987

[54] RAIN COVER FOR GOLF BAG

[76] Inventors: Andy Pilney; Harry Wood, both of 6465 Oakland Dr., New Orleans, La. 70118

[21] Appl. No.: 785,991

[22] Filed: Oct. 10, 1985

[51] Int. Cl.[4] ..... A45B 3/00; A45B 15/00; B65D 65/02; A63B 55/00

[52] U.S. Cl. ..... 135/16; 135/34; 135/99; 150/52 G; 206/315.4

[58] Field of Search ..... 135/98, 99, 16, 19, 135/21, 34, 20 A, 20 R; 446/46; 206/315.3, 315.4, 315.6, 315.8; 150/52 G, 52 E

[56] References Cited

U.S. PATENT DOCUMENTS

| | | | |
|---|---|---|---|
| 1,562,030 | 11/1925 | Lawrence | 206/315.4 |
| 1,583,831 | 5/1926 | Hoigaard | 135/98 |
| 2,471,169 | 5/1949 | Salzberg et al. | 206/315.4 |
| 2,520,226 | 8/1950 | Smith | 206/315.4 |
| 2,704,563 | 3/1955 | Henrich | 150/52 G |
| 2,973,794 | 3/1961 | Erickson | 150/52 G |
| 3,128,812 | 4/1964 | Scheurer | 150/52 G |
| 3,545,760 | 12/1970 | Wilson | 446/46 X |
| 3,913,648 | 10/1975 | Sessler | 150/52 G |
| 3,938,570 | 2/1976 | Stewart | 150/52 G |
| 3,977,451 | 8/1976 | Duba | 150/52 G |
| 4,115,946 | 9/1978 | Vukmirovich | 446/46 X |
| 4,453,632 | 6/1984 | Clower | 206/315.4 |
| 4,498,579 | 2/1985 | Brick | 150/52 G |
| 4,522,300 | 6/1985 | Hamblet | 135/16 X |

FOREIGN PATENT DOCUMENTS

| | | | |
|---|---|---|---|
| 2107594 | 5/1983 | United Kingdom | 206/316.4 |

*Primary Examiner*—Robert A. Hafer
*Assistant Examiner*—D. Neal Muir
*Attorney, Agent, or Firm*—Keaty & Keaty

[57] ABSTRACT

A rain cover for a golf bag comprised of an umbrella-like cover of rain proof material for draping over the top of an otherwise opened golf bag for golf clubs (FIG. 1). The cover includes on its underside at its center an elastic sock, which is engagingly placed over the head of one of the clubs in the golf bag to hold the cover over the bag. The cover includes along its peripheral edge a hem whch has sewn within it a light chain or other flexible weight (FIG. 2A). The weighted periphery maintains the rain cover over the golf club bag in spite of winds and the like, while also allowing easy access to the user to the golf club bag by merely picking up the desired portion of the cover providing easy access into the interior. The cover cam include the elastic sock as an integral part or a pre-existing sock used in the art as a club head cover can be adapted for connection to the underside of the cover by means of for example snaps (FIG. 4A) or "Velcro" type strips (FIG. 4B).

9 Claims, 6 Drawing Figures

RAIN COVER FOR GOLF BAG

BACKGROUND OF INVENTION

The present invention relates to a rain cover for a golf club bag for preventing rain from going into the bag, and more particularly to a flexible cover which is draped over the top of the bag supported by one or more golf clubs which are contained in the bag.

Rain is a common problem to golfers. When golfers are caught in the rain or are playing in for example a light rain, it is highly desirable to keep rain out of the golf club bag.

There are some patents which relate to the problem of providing temporary cover for a golf bag in order to protect the clubs and bag interior in a rain storm or the like, but allowing access to the clubs in such a situation.

For example, U.S. Pat. No. 1,819,912 issued in 1931 to H. McGaffey and U.S. Pat. No. 3,913,648 issued in 1975 to S. Sessler disclose a golf club bag cover made of flexible material which is draped about the top of the golf club bag.

In Sessler, a series of weights 54 are included along its periphery to hopefully maintain the cover edges down around the bag. However, the weights are spaced and very localized and not continuous.

In McGaffey an individual golf club's shaft is used as a vertical support for the cover. However, the McGaffey design is relatively complex, and the handle end of the club is used for the cover connection, requiring the club to be inverted from its normal position in the bag. Additionally, pre-existing items such as the elasticized club head cover, cannot be used for the cover/club interface.

Accordingly, the present invention is directed to overcome the deficiencies known in the and to provide a golf club bag cover which is highly practical, economical, compact in storage, reliable and easily put into place and removed.

GENERAL DISCUSSION OF THE INVENTION

The present invention is directed to a golf club bag cover used to prevent golf clubs and the bag's interior from getting wet during a rain, which cover had preferably:

(1) a continuous, evenly weighted, outer edge or periphery for a uniform hang;

(2) a sock or club cover type means of securing the rain cover to a golf club head for support over the opening of the bag; with this combination allowing the golf clubs in the bag to be easily removed and returned to the bag without allowing any significant rain to enter the bag.

This latter feature is achieved in the present invention by raising only an edge of the cover, with the weighted edge causing the rain cover to fall back in place when released, re-covering the opening into the bag. The sock or club cover attachment means allows such easy flexibility yet firmly and reliably maintains the cover on the bag, notwithstanding any cross winds or the constant movement of the cover's material by the user.

By such an approach, the rain cover is completely flexible, having no extended rigid parts and thus can be easily folded into a compact configuration down into "pocket" size when not in use. The invention thus attains great strength, firmness and reliability but without any extended rigid structure.

The sock can either be provided as an integral part of the cover or a pre-existing club head cover or sock can be modified with for example snap or "Velcro" type fasteners for fastening to the underside of the "umbrella" cover.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein:

FIG. 2 is a plan view of the extended or spread out cover of FIG. 1; while

DETAILED DESCRIPTION OF THE PREFERRED EXEMPLARY EMBODIMENT(S)

Figure 2:
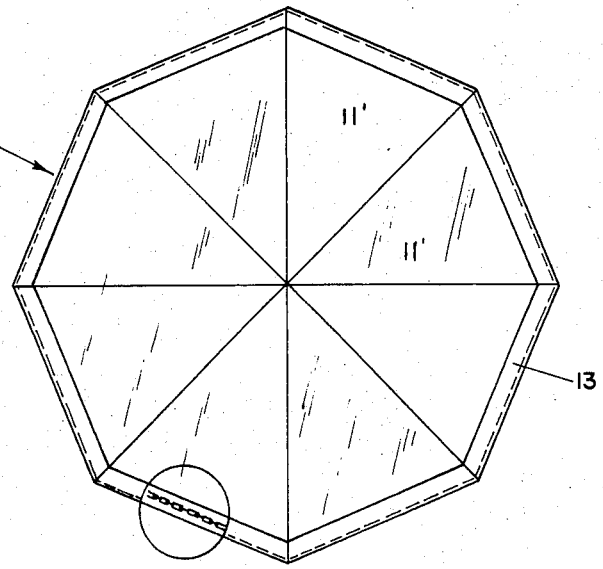
Figure 2A:
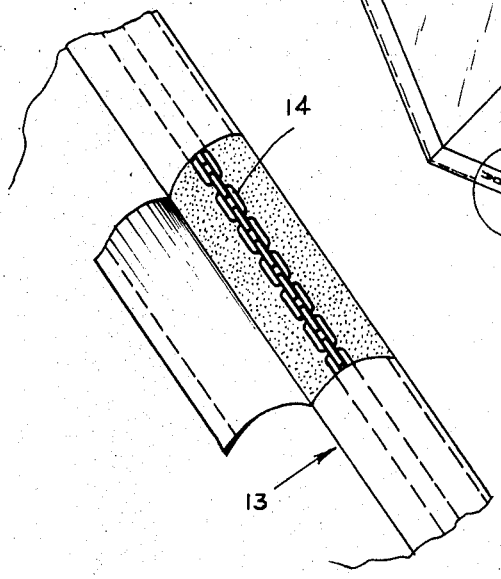
FIG. 2A is a perspective, close-up, detailed view of the peripheral edge or hem of the cover, with a portion of the fabric cover being cut and pulled away to expose the interior of the hem and the chain which is contained in the peripheral hem.
Figure 3:
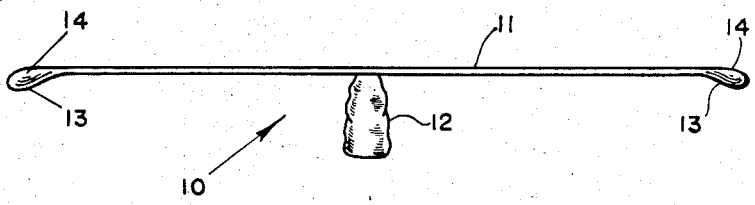
FIG. 3 is a side view of the cover of FIG. 2.

As can be seen in FIGS. 2–3, the preferred, exemplary embodiment of the rain cover 10 of the present invention includes a basic fabric body 11 of flexible rain proof material similar for example to the shape and the type of the standard umbrella without its ribs.

All along the peripheral edge of the body 11 is a continuous hem 13 formed by folding over the edging of the body 11 to form a cavity within which is placed and sewn a flexible, light, extended chain 14. Thus, the chain 14 is sewn and held inside the hem 13. The continuous chain 14, serving as an exemplary flexible weight, keeps the cover 10 hanging securely around the bag 20 even in a good wind.

Sewn onto the central, underside of the rain cover body 11 is a securing cover or sock 12 made of an elastic stretch material, similar to golf club head covers already known.

When the rain cover 10 is hung over the clubs and the open golf bag 20, a tall club head of an available club 30 (for example a driver or a No. 2 or No. 3 wood) is slipped into the sock cover fastening means 12. This elastically secures the cover 10 and prevents it from slipping or falling off due to for example winds or the grasping and pulling of the cover 10 by the user in gaining access to the interior under the cover 10.

Figure 1:
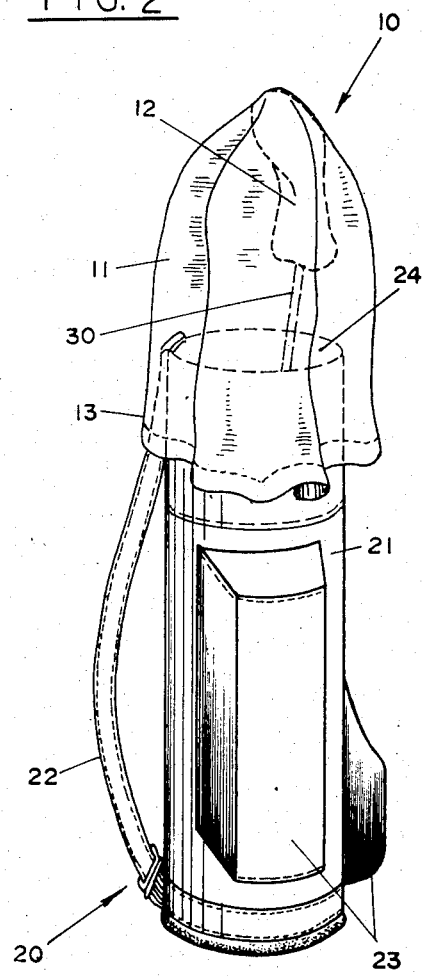
FIG. 1 is a side, perspective view showing the preferred embodiment of the rain cover of the present invention in place in use over the top of a golf club bag, with the supporting, exemplary golf club and the connecting cover or sock shown in phantom line.

As can be seen in FIG. 1, the golf club bag 20 is of standard configuration, forming no part of the invention, and includes a basic cylindrical body 21 and a carrying strap 22. Compartments 23 are also included for storage of various items, including for example the rain cover 10 of the present invention, when it is not in use. The basic cylindrical body 21 of the golf bag 20 includes an upper open end 24.

It is noted that the basic body 11 of the cover 10 is preferably at least generally round having a number of different sections 11', for example eight as illustrated, or six sides, etc., the specific details of the acutal shape of the body 11 not being critical or important, as long as the cover 10 is preferably flexible throughout its body and is of sufficient size to securely cover over the opening 24 and not overly large to unnecessarily be in the way.

When no longer needed, the cover 10 can be folded up into a small, compact package, because of the absence of any elongated rigid members, to approximately "pocket" size. This allows it to be conveniently stored for example in the compartment 23.

Figure 4A:
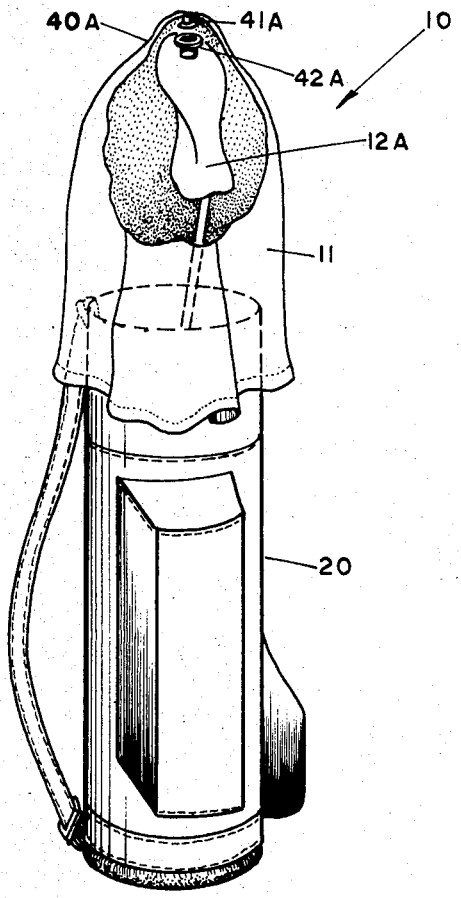
FIGS. 4A and 4B are side, perspective views similar to that of FIG. 1 but, rather than the integral fastening of the rain cover and sock of FIGS. 1 and 3, showing a snap fastening and a "Velcro" type fastening, respectively, of the sock to the rain cover, with the sock and the rain cover being separated from each other a slight distance to better illustrate the fastening elements.
Figure 4B:
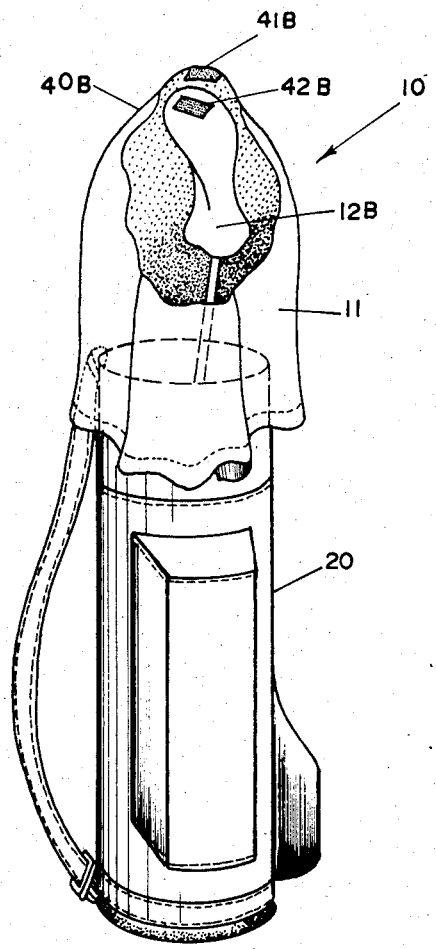

The sock 12 can be integrally provided as a permanently attached part of the rain cover 11, as generally illustrated in FIGS. 1 and 3. Alternatively, a pre-existing, standard type club head cover 12A/12B can be adapted for use by providing temporary or easily applied fasteners 40A/40B, as illustrated in FIGS. 4A/4B, respectively. In the embodiment of FIG. 4A, exemplary snaps 41A and 42A can be each fixedly attached to their respective parts, namely rain cover 11 and sock 12A; or, alternatively, in the embodiment of FIG. 4B, "Velcro" strips 41B and 42B can be used. Of course, many other type fasteners could be used.

The use of the temporary fasteners 40A/40B allows the fastening socks 12A/12B to be used independently of the rain cover 11 to merely cover a golf club head in for example good weather. Then, when inclement weather arises, the rain cover 11 is removed from its storage compartment 23, unfolded and fastened to the sock 12A/12B with the fasteners 40A/40B, respectively.

Because many varying and different embodiments may be made within the scope of the inventive concept herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A cover for a golf club bag, said golf club bag having an open top with an edge and containing at least one golf club therein, said cover comprising:

a flexible body having a periphery provided with a hem, said flexible body extending at least a distance below the top edge of the golf club bag in covering relationship over the open top of the golf club bag;

a flexible weight means secured within the hem about the periphery of the flexible body; and a means for securing the flexible body to the individual golf club, said securing means comprising a golf club head cover fixedly attached directly to a center underside of the flexible body and internally configured to fit in covering relationship over an individual golf club head.

2. The cover of claim 1, wherein the flexible weight means comprises a chain.

3. A rain cover for a golf club bag, said golf club bag having an upper open end and containing at least one golf club therein, the rain cover comprising:

a flexible body of weather resistant material, said body being of a size at least sufficient to completely cover said open end of the golf club bag while there is at least one golf club in said bag, whereby said body can be placed for covering the upper open end of the golf club bag;

a hem extending along and completely around the periphery of said body;

a weight means associated along the length of said hem; and securing means attached to the central, underside of said body for securing the cover to the head of at least one golf club located within a golf club bag, said securing means comprising a flexible sock placeable over and engaging the head of the golf club; and means for attaching said body directly to said sock, whereby said body in use will removably cover an open end of a golf club bag with the weight means at the hem holding it down but allowing easy access into the bag.

4. The cover of claim 3, wherein: said weight means comprises a light weight, continuous chain.

5. The cover of claim 4, wherein: said flexible body is of a generally umbrella-like shape, and the chain is secured within said hem.

6. The cover of claim 3, wherein:

a fastener means is provided between an underside of said flexible body and the upper part of said sock for allowing said flexible body and said sock to be releasably attached when the rain cover is in use and detached when said flexible body is not in use.

7. The cover of claim 6, wherein said fastener means comprises a pair of snap elements.

8. The cover of claim 6, wherein said fastener means comprises a pair of flexible hook and loop fastening strips.

9. The cover of claim 3, wherein said sock comprises a golf club head cover fixedly attached to the underside of the flexible body and internally configured to fit in covering relationship over an individual golf club head.

* * * * *